US006703911B1

(12) United States Patent
DeCormier

(10) Patent No.: US 6,703,911 B1
(45) Date of Patent: Mar. 9, 2004

(54) VERY HIGH FREQUENCY (VHF) SHARP TUNED ELLIPTIC FILTER AND METHOD

(75) Inventor: William A. DeCormier, Poland, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/251,778

(22) Filed: Sep. 23, 2002

(51) Int. Cl.[7] ..... H01P 1/20

(52) U.S. Cl. ..... 333/203; 333/174; 333/208; 333/209

(58) Field of Search ..... 333/203, 205, 333/208, 209, 177, 185, 175, 219

(56) References Cited

U.S. PATENT DOCUMENTS 5,495,216 A * 2/1996 Jachowski ..... 333/208
6,538,532 B2 * 3/2003 Petrovic ..... 333/177
6,577,040 B2 * 6/2003 Nguyen ..... 310/309
2001/0055960 A1 * 12/2001 Abdelmonem ..... 455/307

* cited by examiner

*Primary Examiner*—Brian Young
*Assistant Examiner*—John B Nguyen
(74) *Attorney, Agent, or Firm*—Baker & Hostetler, LLP

(57) ABSTRACT

A sharp-cutoff VHF elliptic filter includes a folded signal path and internally coupled feedback in a conductive enclosure. Sized for the power requirements of commercial television broadcast transmission, the filter implements the elliptic filter equation through use of cavities, resonators, and couplers. The negative feedback required by the elliptic filter equation is implemented by folding the RF signal path and coupling the feedback energy through a gap in an internal septum to sum negatively with the signal in the main signal path. The elliptic filter can have an interdigital configuration, which puts successive resonators on opposite walls of the enclosure and couples the signal at half-wavelength spacing. The elliptic filter can alternatively have a comb line configuration, which places all resonators on one wall and employs full-wavelength spacing.

22 Claims, 4 Drawing Sheets

VERY HIGH FREQUENCY (VHF) SHARP TUNED ELLIPTIC FILTER AND METHOD

FIELD OF THE INVENTION

The present invention relates generally to radio frequency transmission lines. More particularly, the present invention relates to very high frequency (VHF) sharp-tuned elliptic filters.

BACKGROUND OF THE INVENTION

Traditional broadcast television (TV) guidelines forbade transmission on adjacent channels in VHF (channels 2 through 13) or UHF (channels 14 through 83) bands in a single service area. This prevented ordinary TV receivers, which previously had limited out-of-band signal rejection capability, from receiving multiple channels simultaneously. A service area is defined to include the realistic good-reception range for TV channels at the transmitter power levels allocated to them by the Federal Communications Commission (FCC). Thus Minneapolis and St. Paul, Min., would be placed in the same service area for frequency allocation purposes, while Philadelphia, Pa. and New York, N.Y. would not. With increasing demand for channel allocations, this rule is in the process of being eased, which will permit, to choose an arbitrary example, channels 8 and 9 to be used in the same service area.

While typical TV receivers have improved significantly regarding out-of-band signal rejection, the burden remains on TV transmitters to ensure that each transmitted channel is essentially free of out-of-band emissions. This in turn demands improved capability in the final filters inserted in the transmission lines between transmitters and antennas for all channels. Existing RF filters for transmission lines typically employ Chebyshev filter architecture, which is well-behaved in the pass band but achieves less than optimum rolloff rate while providing more stop band attenuation than is normally needed.

SUMMARY OF THE INVENTION

It is therefore a feature and advantage of the present invention to implement the elliptic filter model, which provides sharp rolloff—that is, rapid transition from in-band signal passing to out-of-band signal rejection—in a high-performance, high-power transmission line filter.

It is another feature and advantage of the present invention to provide low insertion loss in a high-performance, high-power transmission line filter.

It is another feature and advantage of the present invention to optimize phase characteristics across the pass band in a high-performance, high-power transmission line filter.

The above and other features and advantages are achieved through the application of a novel folded signal path, and through the inclusion of suitable coupling apparatus, as herein disclosed.

In one aspect, the invention provides a sharp-tuned very high frequency (VHF) elliptic filter, comprising a conductive enclosure that defines a signal path compatible with propagation of radio frequency (RF) energy in some portion of the VHF frequency range; a VHF-compatible input penetration configured to allow RF energy arriving at the enclosure to pass within; a VHF-compatible input coupling device configured to allow the RF energy impressed at the input penetration to radiate inside the conductive enclosure; a plurality of RF resonators within the enclosure, each configured to absorb and reradiate the RF energy; a plurality of RF coupling adjusters within the enclosure, each configured to restrict propagation of RF energy from one resonator to the next; a conductive baffle within the enclosure, so positioned that a portion of the signal path exists on both sides of the baffle; an internal coupling mechanism, configured to transfer RF energy through the conductive baffle; a VHF-compatible output penetration configured to allow RF energy present within the enclosure to pass out; and a VHF-compatible output coupling device configured to allow the RF energy present within the conductive enclosure to couple to the output penetration.

In another aspect, the invention provides an apparatus for sharp-tuned filtering of very high frequency (VHF) radio frequency (RF) energy, comprising means for enclosing an RF signal propagation path in a manner compatible with a portion of the VHF frequency range; means for admitting and radiating VHF energy into the enclosed path; means for absorbing and reradiating the VHF energy through a plurality of resonating means; means for restricting propagation of the VHF energy through the resonating means by a plurality of coupling adjustment means; means for guiding the VHF energy within the RF signal propagation path by partitioning; means for coupling the VHF energy between the resonating means otherwise isolated by the partitioning; and means for passing the VHF energy out through the boundary of the enclosing means.

In yet another aspect, the invention provides a method of sharp-tuned filtering of VHF energy, comprising the following steps: enclosing an RF signal propagation path in a manner compatible with a portion of the VHF frequency range; admitting and radiating the VHF energy into the enclosed path; absorbing and reradiating the VHF energy through a succession of resonant elements; restricting propagation of the VHF energy between successive resonant elements by a plurality of coupling adjustments; guiding the VHF energy within the RF signal propagation path by establishment of internal partitioning; coupling the VHF energy between the resonant elements otherwise isolated by partitioning; and passing the VHF energy out through the boundary of the signal propagation path.

There have thus been outlined, rather broadly, the more important features of the invention in order that the detailed description thereof that follows may be better understood, and in order that the present contribution to the art may be better appreciated. There are, of course, additional features of the invention that will be described below and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the present invention includes a conductive envelope that forms the outer walls of the filter. An input assembly having a connector and associated input coupler to insert RF energy from an incoming transmission line into the filter is provided. The apparatus also includes a series of septums—in effect, baffles—functioning, like the outer walls, to constrain the signal flow path within the envelope. A set of internal coupling mechanisms is provided for bypassing the septums with feedback signals, and a set of adjustable resonators is provided for establishing coupling and adjusting the resonant frequency and bandwidth of the signal path. The apparatus also includes a set of coupling adjusters for attenuating the coupling between resonators and an output assembly having an output coupler and connector for transferring the RF energy to the outgoing transmission line and thence to the transmitting antenna.

In accordance with a preferred embodiment of the present invention, the filter assembly uses a series of tuned resonators arranged in a style known to those skilled in the art as an interdigital filter. The interdigital design places successive resonators on the top and bottom wall of the RF cavity. The preferred embodiment organizes the resonators along a folded path. The spacing of the resonators in the cavity, the adjustable length of each resonator, and the presence of coupling adjusters between each two resonators serve together to reject out-of-band signals and to allow the filter to pass the full bandwidth specified for TV transmission. One feature of the present invention is the folding of the signal path, which allows application of negative feedback to earlier stages of the filter through an internal coupling mechanism.

Figure 1:
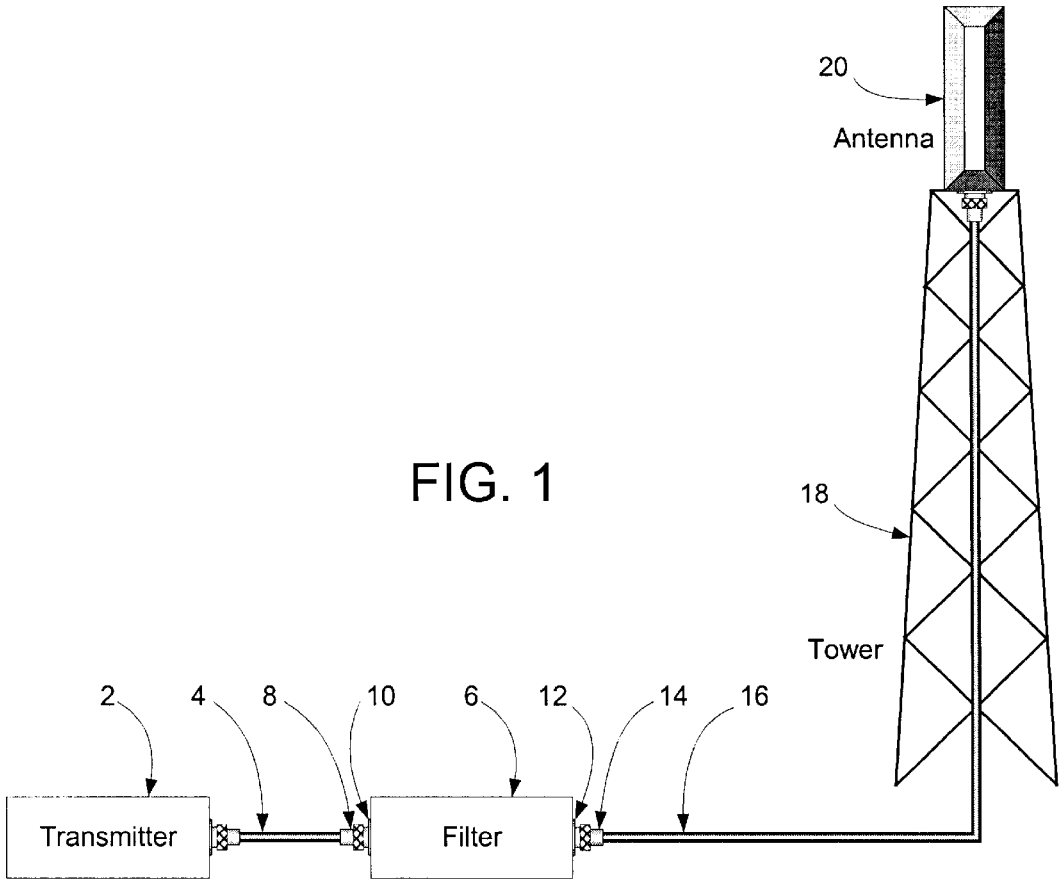
FIG. 1 is a schematic view of a TV transmission system, showing a preferred embodiment of the present invention placed in the signal path.

A typical application of the present inventive apparatus and method is illustrated in FIG. 1. RF energy from a transmitter 2 is carried by an incoming coaxial cable 4 to a filter assembly 6, where it is transferred into the filter assembly 6 via an input plug 8, part of the input coaxial cable 4. The input plug 8 is mated to an input receptacle 10, part of the filter assembly 6. FIG. 1 omits illustration of the internal working of the filter assembly 6, which will be addressed below in FIG. 2. After filtering, the RF energy available at an output receptacle 12 on filter 6 is fed to output plug 14 on output coaxial cable 16. The output cable 16 carries the filtered RF energy to a tower 18, then up the tower 18 to a transmitting antenna 20, where the RF energy is radiated to the reception area.

Figure 2:
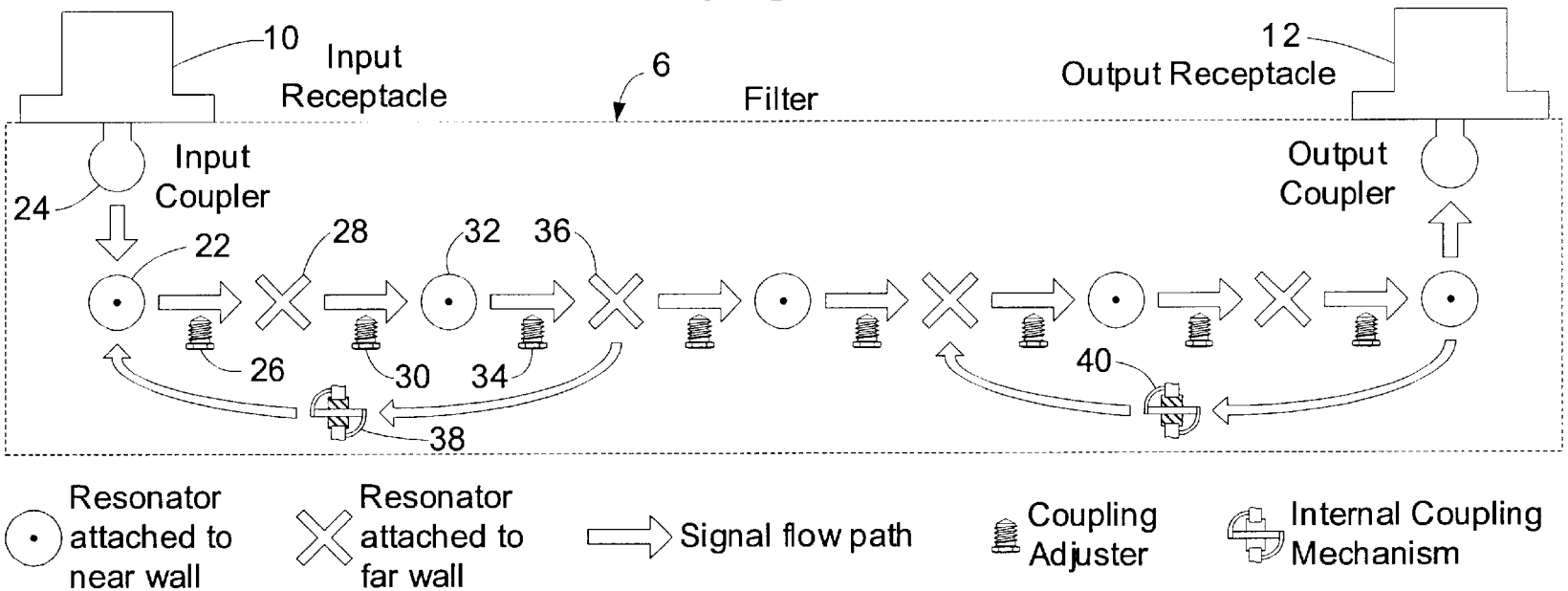
FIG. 2 is a schematic representation of the functions of a preferred embodiment of the present invention, illustrating a sequence of couplers, resonators, and adjusters used to perform the RF filter function.

FIG. 2 illustrates the RF energy flow path within the filter. RF energy introduced into a filter apparatus 6 at an incoming receptacle 10 is radiated to a first resonator 22 by an input coupler 24. The shape and conductive wall material of the cavity permit the RF energy to propagate freely from the first resonator 22. A first resonator coupling adjuster 26 provides fine adjustment to the path between the first resonator 22 and a second resonator 28. By a similar process, the RF signal is detected and reradiated by the second resonator 28, a second coupling adjuster 30 performs the same function of fine-tuning the coupling to a third resonator 32, and a third coupling adjuster 34 fine-tunes the coupling to a fourth resonator 36. At this point, a portion of the RF energy is captured by an internal coupling mechanism 38 and fed back to the first resonator 22, where it adds with negative phase to satisfy the requirements of the elliptic filter equations.

The same sequence of steps, namely sending the RF signal from resonator to resonator with coupling adjusters between each two resonators, continues through the remainder of this schematic of the preferred embodiment of the invention. A second feedback step occurs at an internal coupling mechanism 40.

The number of resonators and feedback stages required to perform the filtering for a particular application is a function of the system specification for that application. The nine resonators shown in this preferred embodiment illustrate two feedback stages, although a different number of feedback stages may be used.

Figure 3:
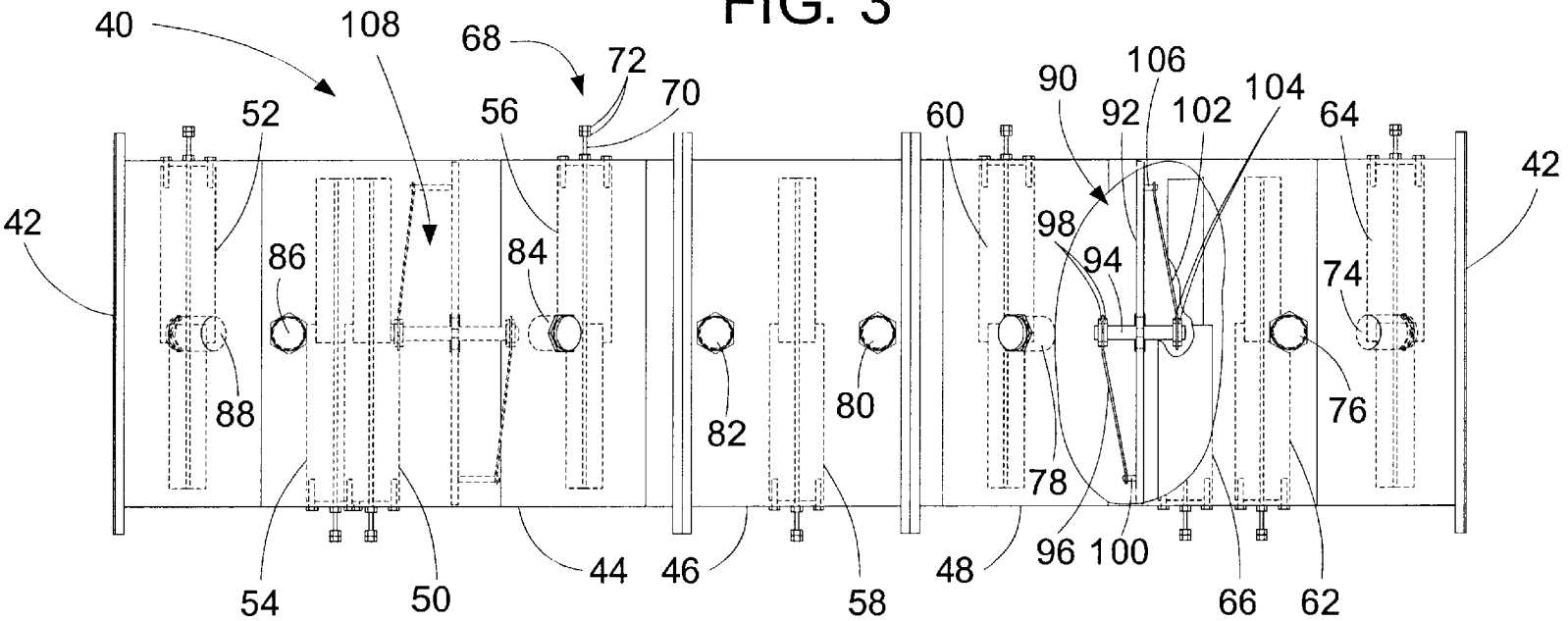
FIG. 3 is a frontal view illustrating certain elements of a preferred embodiment of the present invention.

A preferred embodiment of the filter whose application has been described above is illustrated with a front-view graphic in FIG. 3. Here, an outer envelope 40 with two end plates 42 is used. The envelope 40 of the preferred embodiment is preferably fabricated in three sections 44, 46, and 48, for manufacturing and assembly convenience. The incoming receptacle and input coupler discussed above are not shown in this view. A set of resonators 50, 52, 54, 56, 58, 60, 62, 64, and 66 are shown in profile in hidden line. Resonators 52, 56, 60, and 64 are attached to the upper wall in this interdigital configuration, while resonators 50, 54, 58, 62, and 66 are attached to the lower wall. All are shown in the fully extended position, whereas most or all would normally be adjusted to a shorter length during the process of tuning an individual filter unit. A protruding assembly 68 on each of the resonators represents the length adjustment hardware, a screw 70 and two lock nuts 72 to permit precise adjustment and stability. The mounting and adjustment access hardware for a set of coupling adjusters 74, 76, 78, 80, 82, 84, 86, and 88 are shown, protruding from the visible sidewall and the far, hidden wall. A first internal coupling mechanism 90, comprising a septum 92 penetrated by a first center post 94, with a first pickup coupling strap 96 mounted using first pickup adjusting nuts 98 and a first pickup standoff 100, captures some of the RF energy present at fourth resonator 56. The first center post 94 conducts that RF energy to a first radiating coupling strap 102, held to first center post 94 by two first radiating adjusting nuts 104, its far end shorted to the first septum 92 by a first radiating standoff 106, and reradiates it to first resonator 50. A second internal coupling mechanism 108 uses identical construction (other than post length, which determines amplitude) to couple feedback from the ninth resonator 66 back to the sixth resonator 60.

Figure 4:
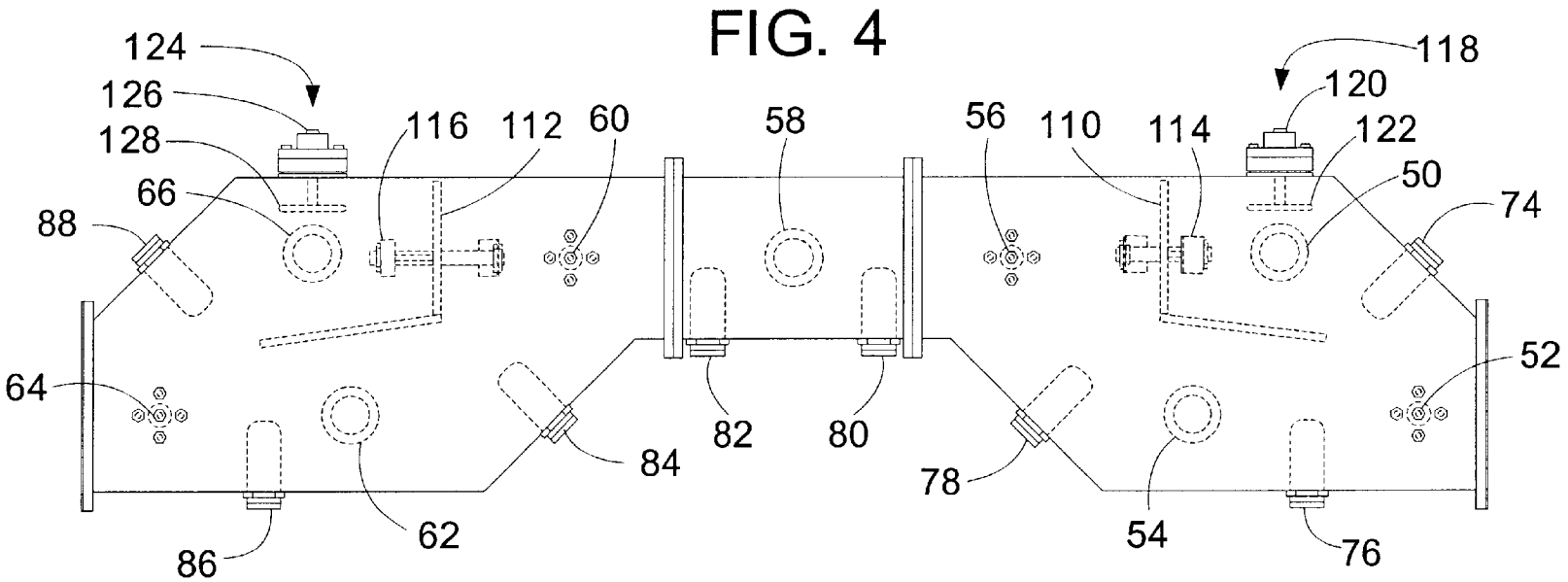
FIG. 4 is a plan view illustrating certain elements of a preferred embodiment of the present invention.

A top view of the preferred embodiment is provided in FIG. 4. In this view, the folded path is evident, with the two septums 110 and 112 providing barriers to direct RF access between resonators except along the defined path. A set of resonators using the same numbers as in FIG. 3 are shown here from the adjustment end in the case of resonators 52, 56, 60, and 64, which are mounted to the top surface and point down, and in hidden line for resonators 50, 54, 58, 62, and 66, which are mounted to the bottom and point up. Coupling adjusters 74, 76, 78, 80, 82, 84, 86, and 88 are shown in profile; their intrusion into the signal path between resonators is adjustable. Septums 110 and 112 are penetrated by internal coupling mechanisms 114 and 116, respectively, shown in profile in this view. Internal coupling mechanism 114 acquires RF from resonator 56 and reradiates it toward resonator 50. The same process applies with internal coupling mechanism 116, which feeds back RF from resonator 66 to resonator 60. The differing dimensions on the two internal coupling mechanisms 114 and 116 permit coupling at different signal levels. They are each adjustable within a range suitable to the filter feedback terms that they realize. An input feed 118 comprising an input penetration 120 and an associated input coupling device 122 and an output feed 124 comprising an output penetration 126 and an associated output coupling device 128 bring RF into the filter from the transmitter and remove it to the antenna respectively.

Many aspects of the design of a transmission line filter are determined by physical and performance constraints. Just as the number of sections, each consisting of resonators, coupling adjusters, and internal coupling mechanisms for feedback, is determined by the filtering performance required of the filter, so the overall physical dimensions of the embodiment are determined by the frequency of operation. Each resonator functions as an antenna, and so preferably should have a height compatible with the frequency at which it is intended to operate. Likewise, the height of the enclosure is frequency-dependent, since successive resonators in an interdigital design are positioned on opposite walls in order to couple efficiently with suitable spacing. Similarly, the incremental spacing between successive resonators varies from the nominal in accordance with the need to provide stagger tuning, which establishes the filter's pass band width.

The above, preferred embodiment describes an embodiment using an interdigital filter. A second embodiment, operating on the same design principles as the interdigital filter except as noted below, uses an embodiment commonly known to those skilled in the art as a comb line filter. A comb line filter differs from an interdigital filter in the positioning of all of the resonators on the same surface of the housing rather than alternating between opposed surfaces. The inventive apparatus described based on an interdigital filter can also be realized using a comb line filter as its basis. For a comb line filter-based apparatus, the resonators and coupling adjusters are again placed in a folded path so that an internal coupling mechanism can provide negative feedback to realize the elliptic filter equations. Differences in resonator spacing permit the comb line filter to have end-to-end electrical performance equivalent to that of the interdigital filter despite internal variations.

For the second embodiment, using a comb line configuration, chamber height is similar to that of the interdigital filter in order minimize surface currents. Resonator height is approximately the same since circuit function differs only in the relative polarity of successive resonators. Spacing between resonators is approximately doubled to couple efficiently and to provide effective stagger tuning.

Accordingly, it is desirable to provide a product with improved rolloff, so long as insertion loss, stop band attenuation, power handling capability, physical size, durability, and environmental compatibility are adequate. It will be appreciated that the invention, in some embodiments, improves rolloff (i.e., provides steeper skirts) in applying Cauer response, also referred to as elliptic response, filter design in place of Chebyshev response, also referred to as equal-ripple response, filter design.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, that fall within the scope of the invention.

What is claimed is:

1. A sharp-tuned very high frequency (VHF) elliptic filter, comprising:

a conductive enclosure that defines a signal path compatible with propagation of radio frequency (RF) energy in some portion of the VHF frequency range;

a VHF-compatible input penetration configured to allow RF energy arriving at said enclosure to pass within;

a VHF-compatible input coupling device configured to allow the RF energy impressed at the input penetration to radiate inside said conductive enclosure;

a plurality of RF resonators within said enclosure, each configured to absorb and reradiate the RF energy;

a plurality of RF coupling adjusters within said enclosure, each configured to restrict propagation of RF energy from one resonator to the next;

a conductive baffle within said enclosure, so positioned that a portion of the signal path exists on both sides of said baffle;

an internal coupling mechanism, configured to transfer RF energy through said conductive baffle;

a VHF-compatible output penetration configured to allow RF energy present within said enclosure to pass out; and a VHF-compatible output coupling device configured to allow the RF energy present within said conductive enclosure to couple to said output penetration.

2. The filter of claim 1, wherein said filter operates in interdigital mode.

3. The filter of claim 1, wherein said filter operates in comb line mode.

4. The filter of claim 1, wherein said internal conductive baffle is attached conductively to said conductive enclosure in order to define a portion of the RF signal path.

5. The filter of claim 1, wherein said input penetration includes a coaxial connector receptacle.

6. The filter of claim 1, wherein said input coupling device includes a radiator of VHF RF energy bonded to said input penetration to form a single unit for electrical conductivity.

7. The filter of claim 1, wherein said RF resonators are frequency-adjustable.

8. The filter of claim 7, wherein said RF resonators are vibration-resistant length adjustable.

9. The filter of claim 1, wherein said RF coupling adjusters are attenuation adjustable.

10. The filter of claim 9, wherein said RF coupling adjusters are vibration-resistant length adjustable.

11. The filter of claim 1, wherein said internal coupling mechanisms include inductive RF coupling loops on opposite sides of said path-defining conductive internal barriers.

12. The filter of claim 11, wherein said internal coupling mechanisms are vibration-resistant.

13. The filter of claim 1, wherein said output coupling device includes a coupler of VHF RF energy bonded to said output penetration to form a single unit for electrical conductivity.

14. The filter of claim 1, wherein said output penetration comprises a coaxial connector receptacle.

15. An apparatus for sharp-tuned filtering very high frequency (VHF) radio frequency (RF) energy, comprising:

means for enclosing an RF signal propagation path in a manner compatible with a portion of the VHF frequency range;

means for admitting and radiating VHF energy into the enclosed path;

means for absorbing and reradiating the VHF energy through a plurality of resonating means;

means for restricting propagation of the VHF energy through the resonating means by a plurality of coupling adjustment means;

means for guiding the VHF energy within the RF signal propagation path by partitioning means;

means for coupling the VHF energy between the resonating means otherwise isolated by the partitioning means; and means for passing the VHF energy out through the boundary of the enclosing means.

16. The apparatus of claim 15, wherein said resonating means permits adjustment of the VHF operating frequency.

17. The apparatus of claim 15, wherein said propagation restricting means permits adjustment in the extent of the restriction.

18. The apparatus of claim 15, wherein said coupling means permits adjustment in the extent of the coupling.

19. A method of sharp-tuned filtering of VHF energy, comprising the following steps:

enclosing an RF signal propagation path in a manner compatible with a portion of the VHF frequency range;

admitting and radiating VHF energy into the enclosed path;

absorbing and reradiating the VHF energy through a succession of resonant elements;

restricting propagation of the VHF energy between the resonant elements by a plurality of coupling adjustments;

guiding the VHF energy within the RF signal propagation path by establishment of internal partitioning;

coupling the VHF energy between resonating elements otherwise isolated by partitioning; and passing the VHF energy out through the boundary of the signal propagation path.

20. The filtering method of claim 19, wherein the resonating step permits adjustment of the VHF operating frequency.

21. The filtering method of claim 19, wherein the propagation restricting step permits adjustment in the extent of the restriction.

22. The filtering method of claim 19, wherein the coupling step permits adjustment in the extent of the coupling.

* * * * *